US008162532B2

(12) United States Patent
Toole

(10) Patent No.: US 8,162,532 B2
(45) Date of Patent: Apr. 24, 2012

(54) DYNAMIC MIXING APPARATUS FOR MULTI-COMPONENT COATINGS

(75) Inventor: Ian Mark Toole, Bowburn (GB)

(73) Assignee: PRC-DeSoto International, Inc., Sylmar, CA (US)

( * ) Notice: Subject to any disclaimer, the term of this patent is extended or adjusted under 35 U.S.C. 154(b) by 760 days.

(21) Appl. No.: 12/269,264

(22) Filed: Nov. 12, 2008

(65) Prior Publication Data

US 2010/0116352 A1 May 13, 2010

(51) Int. Cl.
*B01F 5/00* (2006.01)

(52) U.S. Cl. ..... 366/165.2; 366/165.1; 366/165.3; 366/273; 366/274

(58) Field of Classification Search ..... 366/165.1, 366/165.2, 165.3, 273, 274
See application file for complete search history.

(56) References Cited

U.S. PATENT DOCUMENTS 3,799,854 A 3/1974 Jerabek ..... 204/181
3,919,351 A 11/1975 Chang et al. ..... 260/850
3,981,487 A * 9/1976 Papoff et al. ..... 366/143
4,046,729 A 9/1977 Scriven et al. ..... 260/29.2 TN
4,209,259 A * 6/1980 Rains et al. ..... 366/273
4,527,712 A * 7/1985 Cobbs et al. ..... 222/1
4,546,045 A 10/1985 Elias ..... 428/424.6
4,681,811 A 7/1987 Simpson et al. ..... 428/413
4,732,790 A 3/1988 Blackburn et al. ..... 427/407.1
5,468,802 A 11/1995 Wilt et al. ..... 524/539
7,267,477 B1 * 9/2007 Plache ..... 366/165.2

OTHER PUBLICATIONS

"Pneumatic motor", wikipedia, page from Aug. 25, 2007, accessed Aug. 22, 2011.*
Kremlin Instruction Manual, Proportioning Pump Model PU 2120, Kremlin Rexson, France, Sep. 18, 2006.

* cited by examiner

*Primary Examiner* — Yogendra Gupta
*Assistant Examiner* — Alison Hindenlang

(57) ABSTRACT

A multi-component coating spray application system comprises: a source of a first coating component, a source of a second coating component, a dynamic mixer in fluid flow communication with the sources of the first and second coating components, wherein the dynamic mixer comprises a mixing chamber and a movable stirring member in the mixing chamber, and a spray gun in fluid flow communication with an outlet port of the dynamic mixer.

17 Claims, 4 Drawing Sheets

DYNAMIC MIXING APPARATUS FOR MULTI-COMPONENT COATINGS

FIELD OF THE INVENTION

The present invention relates to mixing of multi-component coatings, and more particularly relates to an apparatus for dynamically mixing coating components before they are applied to a surface with a spray gun.

BACKGROUND INFORMATION

Two-component coating application systems are known in which each of the components are fed through a spray gun in the desired ratio for application to a substrate. Prior to feeding the components to the spray gun, they may pass through proportioning valves which control the mix ratio of the components. A static mixer in the form of a SEMCO type spiral mixer which allows paint to flow over elements prior to application/dispensing may then be conventionally used to mix the components before they are introduced into the spray gun. However, it would be desirable to provide a multi-component spray coating system in which the components are more completely mixed prior to spray application.

SUMMARY OF THE INVENTION

In certain respects, the present invention is directed to providing a multi-component coating spray application system comprising: a source of a first coating component; a source of a second coating component; a dynamic mixer in fluid flow communication with the sources of the first and second coating components, wherein the dynamic mixer comprises a mixing chamber and a movable stirring member in the mixing chamber; and a spray gun in fluid flow communication with an outlet port of the dynamic mixer.

In other respects, the present invention is directed to providing a dynamic mixer for multi-component coatings comprising: a mixing chamber; a movable stirring chamber in the mixing chamber; a first inlet port connectable to a source of a first coating component; a second inlet port connectable to a source of a second coating component; and an outlet port connectable to a spray gun.

In further respects, the present invention is directed to providing a method of mixing multiple coating components prior to spray application. The method comprises: providing first and second coating components to a mixing chamber; mixing the first and second coating components in the mixing chamber with a movable stirring element to form a coating mixture; and feeding the coating mixture from the mixing chamber to a coating spray gun.

DETAILED DESCRIPTION

For purposes of the following detailed description, it is to be understood that the invention may assume various alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

Figure 1:
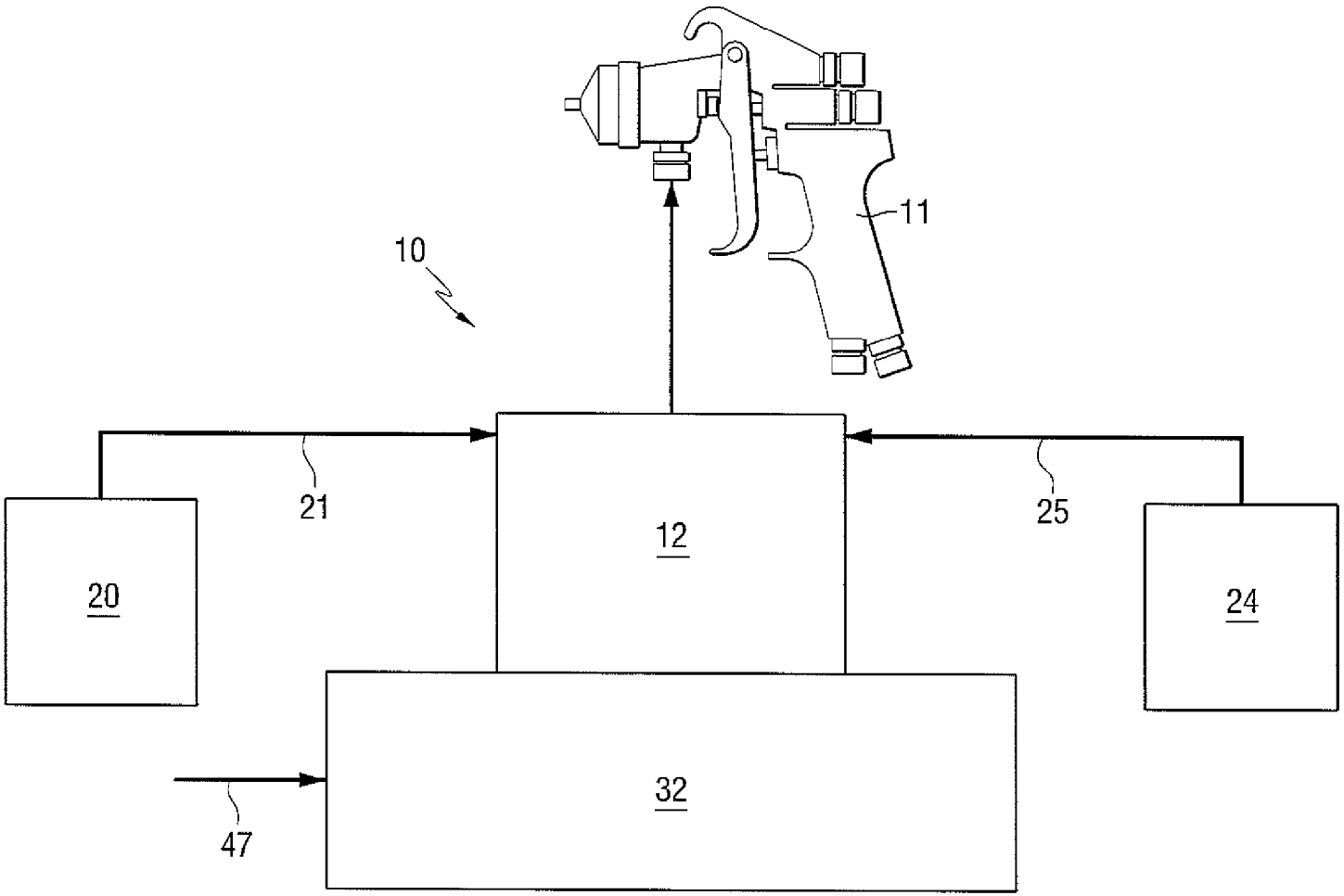
FIG. 1 schematically illustrates a multi-component spray coating system including a dynamic mixing apparatus in accordance with an embodiment of the present invention.
Figure 2:
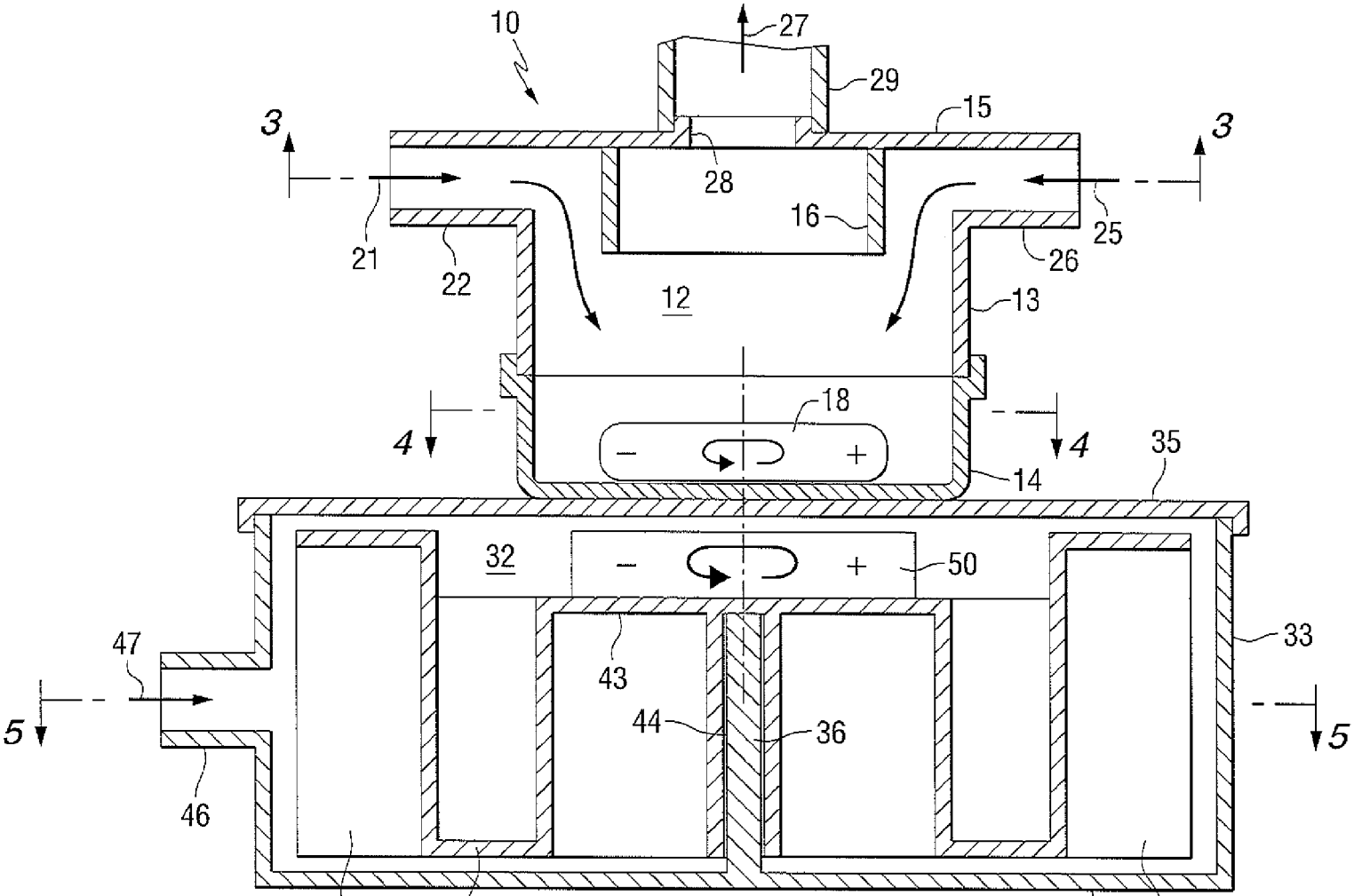
FIG. 2 is a partially schematic side sectional view of a dynamic mixing apparatus in accordance with an embodiment of the present invention.

FIG. 1 schematically illustrates a multi-component spray coating system in accordance with an embodiment of the present invention. The system includes a dynamic mixing apparatus 10 in which at least two coating components are mixed and fed to a coating spray gun 11. As shown in FIG. 2, the dynamic mixer 10 includes a mixing chamber 12 having a cylindrical sidewall 13, a base 14 and a top 15. In the embodiment shown in FIG. 2, the mixing chamber 12 can be opened by means of a threaded coupling, or any other suitable connection, between the cylindrical sidewall 13 and the base 14. As shown most clearly in FIGS. 2 and 3, the mixing chamber 12 has a cylindrical baffle 16 which serves to divert the incoming flow of coating components for improved mixing, as more fully described below. As shown in FIGS. 2 and 4, a stirring element 18 in the form of an elongated permanent magnet loosely rests on the base 14 of the mixing chamber 12.

Figure 3:
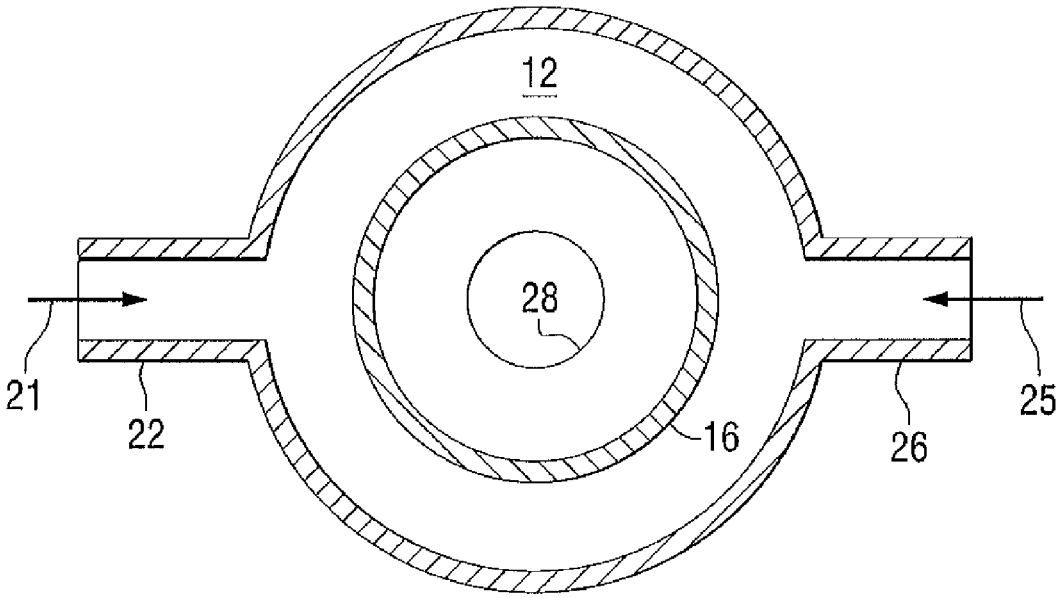
FIG. 3 is a cross-sectional view taken through section 3-3 of FIG. 2.
Figure 4:
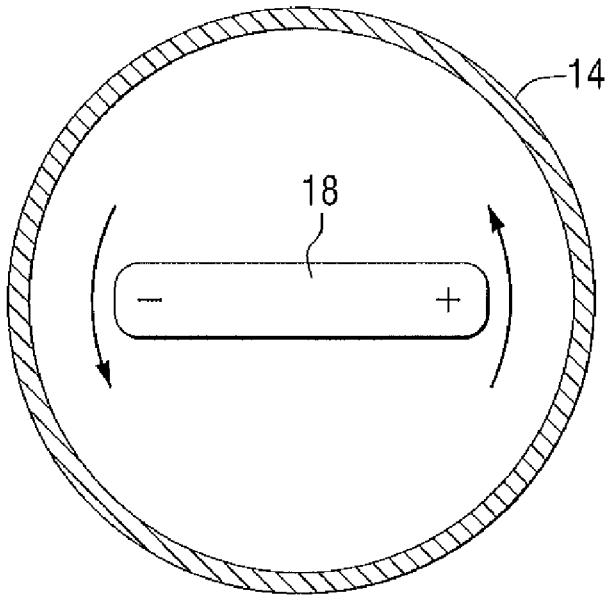
FIG. 4 is a cross-sectional view taken through section 4-4 of FIG. 2.

As shown in FIGS. 1-3, a source of a first coating component 20 flows via line 21 through a first coating component inlet port 22 into the chamber 12. A source of a second coating component 24 is fed via inlet line 25 through a second coating component inlet port 26 into the mixing chamber 12. As shown by arrows in FIG. 2, the flow paths of the first and second coating components 21 and 25 are diverted in the mixing chamber 12 by the cylindrical baffle 16. After the first and second coating components have been mixed in the mixing chamber 12, the resultant mixture is fed via line 27 from an outlet port 28 of the mixing chamber to the spray gun 11. The spray gun 11 may be any suitable type of spray gun known to those skilled in the art such as those commercially available from manufacturers such as Devilbiss, Graco, Kremlin, Binks and Wagner. While a two-component coating system is shown in the figures, it is to be understood that any other multi-component coating composition may be mixed and delivered to a spray gun in accordance with the present invention. For example, a three-component coating may be dynamically mixed, in which case a third inlet port (not shown) may be added to the mixing chamber 12.

Figure 5:
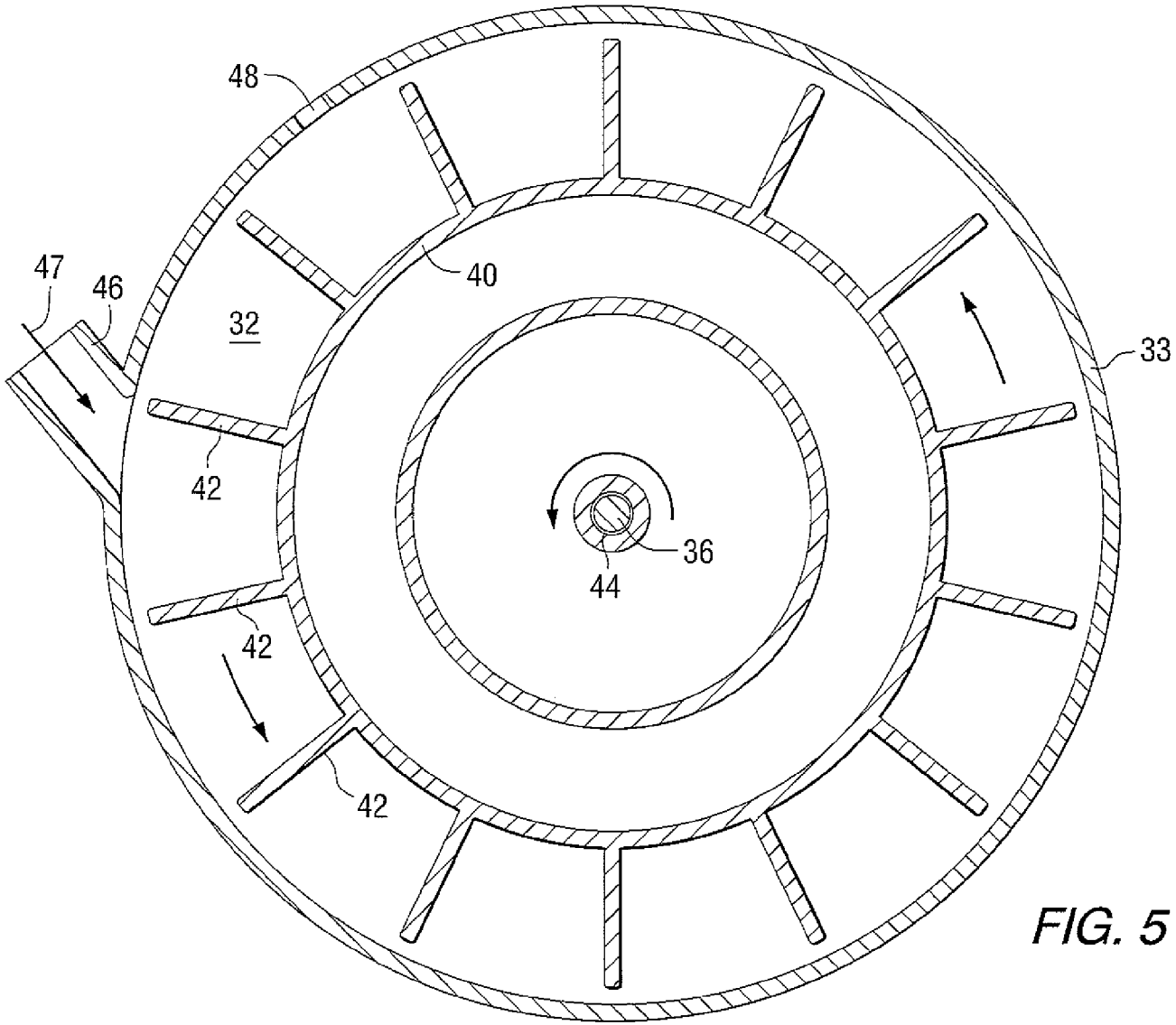
FIG. 5 is a cross-sectional view taken through section 5-5 of FIG. 2.

As shown in FIGS. 1, 2 and 5, the dynamic mixer 10 also includes a drive chamber 32 that is used to rotate the magnetic stirring element 18 contained in the mixing chamber 12. The drive chamber 32 has a cylindrical sidewall 33, a base 34 and a removable top 35. The top 35 may be engaged with the cylindrical sidewall 33 by any suitable means, such as a threaded connection, snap fit or the like. A support pin 36 extends upward from the base 34 in the axial center of the drive chamber 32. A rotatable impeller 40 having multiple radially extending paddles 42 at its outer periphery is rotatably mounted in the drive chamber 32 by means of a central hub 43 having a cylindrical hole or recess 44 which receives the support pin 36. The drive chamber 32 includes an inlet port 46 through which a pressurized fluid may flow 47. In one embodiment, the pressurized fluid is provided in the form of pressurized air from any suitable type of compressed air source. An exhaust port 48 allows the air to escape from the drive chamber 32. An elongated permanent magnet 50 is fixedly mounted on the central hub 43 of the impeller 40.

As shown most clearly in FIG. 5, when pressurized air 47 flows through the inlet port 46, it contacts the paddles 42 and causes the impeller 40 to rotate around its central axis. Rotation of the impeller 40 causes rotation of the permanent magnet 50 which, in turn, causes rotation of the magnetic stirring element 18 inside the mixing chamber 12. In this manner, the first and second components of the coating are dynamically mixed in the mixing chamber 12 by rotation of the magnetic stirring element 18. The rotational velocity or rate of the magnetic stirring element 18 may be selected as desired, for example, up to 800 rpm. For example, a rotational rate of from 120 to 240 rpm may be suitable for many coating applications.

The dimensions of the mixing chamber 12, magnetic stirring element 18, drive chamber 32 and impeller 40 may be selected by those skilled in the art without undue experimentation. For example, the mixing chamber 12 may have an inner diameter of from 2.5 to 7.5 cm, and a height of from 2.5 to 10 cm. The magnetic stirring element 18 may have a length of from 2.5 to 4.5 dependent on the size of the chamber. In one embodiment, the magnetic stirring element 18 is generally cylindrical with rounded or convex ends. A typical diameter of a cylindrical magnetic stirring element is from 2.5 to 4.5 cm.

The drive chamber 32 may have an inner diameter of from 6 to 12 cm, and a height of from 5 to 12 cm. The impeller 40 is sized to fit within the drive chamber 32 and may have an outer diameter of 2.5 to 5 cm. The size and number of paddles 42 of the impeller 40 may be selected by those skilled in the art based upon the desired rotation rate and size of the impeller 40, as well as the pressure and/or flow rate of the pressurized fluid 47 through the air inlet port 46. A typical pressure for the pressurized air flow 47 is from 6 to 8 psi.

The various components of the dynamic mixer 10 may be made of any suitable materials. For example, the mixing chamber 12, drive chamber 32 and impeller 40 may be made of polymers such as PTFE, PVDF and the like.

The flow rates and mix proportions of the first and second coating components 21 and 25 flowing into the dynamic mixing chamber 12 may be routinely selected by those skilled in the art. For example, typical flow rates for the first and second coating components may be from 25 ml to 500 ml. Typical mix ratios of the first to second coating components may be from 1:100 to 100:1, typically from 3:1 to 2:1.

In order to provide more complete mixing of the first and second coating components in the mixing chamber 12, the components are diverted by the cylindrical baffle 16 as they enter the chamber 12. As shown in FIG. 2, the inlet flows of the first and second coating components are diverted from substantially horizontal radial inward flows from opposite sides of the mixing chamber 12 to a downward flow toward the magnetic stirring element 18. As the components are mixed by the magnetic stirring element 18, the mixture is forced upward through the outlet port 28 of the mixing chamber 12 to the spray gun 11. Mixing times within the chamber 12 are controlled by the size of the chamber and the flow rates of the incoming first and second components 21 and 25. Typically, mixing times of from 2 to 10 seconds are suitable for many coating compositions and applications.

The first and second coating components may comprise any suitable compositions. For example, the coating compositions may include a film-forming resin or base. As used herein, "film-forming" refers to resins that can form a self-supporting continuous film on at least a horizontal surface of a substrate upon removal of any solvents or carriers present in the composition or upon curing at ambient or elevated temperature.

Conventional film-forming resins that may be used in one or more of the components of the coating compositions include those typically used in automotive OEM coating compositions, automotive refinish coating compositions, industrial coating compositions, architectural coating compositions, powder coating compositions, coil coating compositions, and aerospace coating compositions, among others.

Suitable resins include, for example, those formed from the reaction of a polymer having at least one type of reactive functional group and a curing agent having functional groups reactive with the functional group(s) of the polymer. As used herein, the term "polymer" is meant to encompass oligomers, and includes without limitation both homopolymers and copolymers. The polymers can be, for example, acrylic, polyester, polyurethane or polyether, polyvinyl, cellulosic, acrylate, silicon-based polymers, co-polymers thereof, and mixtures thereof, and can contain functional groups such as epoxy, carboxylic acid, hydroxyl, isocyanate, amide, carbamate and carboxylate groups.

The acrylic polymers, if used, are typically copolymers of acrylic acid or methacrylic acid or hydroxyalkyl esters of acrylic or methacrylic acid such as hydroxyethyl methacrylate or hydroxypropyl acrylate with one or more other polymerizable ethylenically unsaturated monomers such as alkyl esters of acrylic acid including methyl methacrylate and 2-ethyl hexyl acrylate, and vinyl aromatic compounds such as styrene, alpha-methyl styrene and vinyl toluene. The ratio of reactants and reaction conditions are selected to result in an acrylic polymer with pendant hydroxyl or carboxylic acid functionality.

Besides acrylic polymers, the coating compositions can contain a polyester polymer or oligomer, including those containing free terminal hydroxyl and/or carboxyl groups. Such polymers may be prepared in a known manner by condensation of polyhydric alcohols and polycarboxylic acids. Suitable polyhydric alcohols include ethylene glycol, neopentyl glycol, trimethylol propane and pentaerythritol.

Suitable polycarboxylic acids include adipic acid, 1,4-cyclohexyl dicarboxylic acid and hexahydrophthalic acid.

Besides the polycarboxylic acids mentioned above, functional equivalents of the acids such as anhydrides where they exist or lower alkyl esters of the acids such as the methyl esters may be used. Also, small amounts of monocarboxylic acids such as stearic acid may be used.

Hydroxyl-containing polyester oligomers can be prepared by reacting an anhydride of a dicarboxylic acid such as hexahydrophthalic anhydride with a diol such as neopentyl glycol in a 1:2 molar ratio.

Where it is desired to enhance air-drying, suitable drying oil fatty acids may be used and include those derived from linseed oil, soya bean oil, tall oil, dehydrated castor oil or tung oil.

Polyurethane polymers containing terminal isocyanate or hydroxyl groups may also be used. The polyurethane polyols or NCO-terminated polyurethanes which can be used include those prepared by reacting polyols including polymeric polyols with polyisocyanates. The polyurea-containing terminal isocyanate or primary or secondary amine groups which can be used include those prepared by reacting polyamines including polymeric polyamines with polyisocyanates. The hydroxyl/isocyanate or amine/isocyanate equivalent ratio is adjusted and reaction conditions selected to obtain the desired terminal group. Examples of suitable polyisocyanates include those described in U.S. Pat. No. 4,046,729 at column 5, line 26 to column 6, line 28, hereby incorporated by reference. Examples of suitable polyols include those described in U.S. Pat. No. 4,046,729 at column 7, line 52 to column 10, line 35, hereby incorporated by reference. Examples of suitable polyamines include those described in U.S. Pat. No. 4,046,729 at column 6, line 61 to column 7, line 32 and in U.S. Pat. No. 3,799,854 at column 3, lines 13 to 50, both hereby incorporated by reference.

A silicon-based polymer can also be used in one or more of the coating components. As used herein, by "silicon-based polymers" is meant a polymer comprising one or more —SiO— units in the backbone. Such silicon-based polymers can include hybrid polymers, such as those comprising organic polymeric blocks with one or more —SiO— units in the backbone.

Certain coating compositions can include a film-forming resin that is formed from the use of a curing agent. For example, the first coating component may comprise a base or film-forming resin as described above, while the second coating component may comprise a curing agent. Curing agents suitable for use in the coating compositions can include aminoplast resins and phenoplast resins and mixtures thereof, as curing agents for OH, COOH, amide, and carbamate functional group containing materials. Examples of aminoplast and phenoplast resins suitable as curing agents in curable compositions include those described in U.S. Pat. No. 3,919,351 at column 5, line 22 to column 6, line 25, hereby incorporated by reference.

Also suitable are polyisocyanates and blocked polyisocyanates as curing agents for OH and primary and/or secondary amino group-containing materials. Examples of polyisocyanates and blocked isocyanates suitable for use as curing agents in curable compositions that may be used include those described in U.S. Pat. No. 4,546,045 at column 5, lines 16 to 38; and in U.S. Pat. No. 5,468,802 at column 3, lines 48 to 60, both hereby incorporated by reference.

Anhydrides as curing agents for OH and primary and/or secondary amino group containing materials are well known in the art. Examples of anhydrides suitable for use as curing agents in the coating compositions include those described in U.S. Pat. No. 4,798,746 at column 10, lines 16 to 50; and in U.S. Pat. No. 4,732,790 at column 3, lines 41 to 57, both hereby incorporated by reference.

Polyepoxides as curing agents for COOH functional group containing materials are well known in the art. Examples of polyepoxides suitable for use as curing agents in the coating compositions include those described in U.S. Pat. No. 4,681,811 at column 5, lines 33 to 58, hereby incorporated by reference.

Polyacids as curing agents for epoxy functional group containing materials are well known in the art. Examples of polyacids suitable for use as curing agents in the coating compositions include those described in U.S. Pat. No. 4,681,811 at column 6, line 45 to column 9, line 54, hereby incorporated by reference.

Polyols, that is, material having an average of two or more hydroxyl groups per molecule, can be used as curing agents for NCO functional group containing materials and anhydrides and esters and are well known in the art. Examples of said polyols include those described in U.S. Pat. No. 4,046,729 at column 7, line 52 to column 8, line 9; column 8, line 29 to column 9, line 66; and in U.S. Pat. No. 3,919,351 at column 2, line 64 to column 3, line 33, both hereby incorporated by reference.

Polyamines can also be used as curing agents for NCO functional group containing materials and for carbonates and unhindered esters and are well known in the art. Examples of polyamines suitable for use as in the coating compositions include those described in U.S. Pat. No. 4,046,729 at column 6, line 61 to column 7, line 26, and in U.S. Pat. No. 3,799,854 at column 3, lines 13 to 50, hereby incorporated by reference.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

What is claimed is:

1. A multi-component coating spray application system comprising:

a source of a first coating component;

a source of a second coating component;

a dynamic mixer in fluid flow communication with the sources of the first and second coating components, wherein the dynamic mixer comprises:

a substantially cylindrical mixing chamber;

a movable stirring member in the mixing chamber;

inlet ports, which direct the first and second components radially inward into the mixing chamber;

a cylindrical baffle located in the radial inward flow paths of the first and second components for diverting inward flows of the first and second components to a flow toward the movable stirring member; and an outlet port defined by an inner circumference of the cylindrical baffle and disposed opposite to the movable stirring member; and a spray gun in fluid flow communication with an outlet port of the dynamic mixer.

2. The multi-component coating spray application system of claim 1, wherein the movable stirring member is rotatable.

3. The multi-component coating spray application system of claim 2, wherein the movable stirring member is magnetic.

4. The multi-component coating spray application system of claim 3, wherein the movable stirring member comprises an elongated permanent magnet.

5. The multi-component coating spray application system of claim 1, wherein the inlet ports are located on opposite sides around a circumference of the mixing chamber.

6. The multi-component coating spray application system of claim 5, wherein the outlet port directs a mixture of the first and second components in an axial direction out of the mixing chamber.

7. The multi-component coating spray application system of claim 1, further comprising a driver adjacent to the mixing chamber for moving the stirring element.

8. The multi-component coating spray application system of claim 7, wherein the stirring element is magnetic and the driver comprises a drive magnet which moves the stirring element.

9. The multi-component coating spray application system of claim 8, wherein the drive magnet is a rotatable permanent magnet.

10. The multi-component coating spray application system of claim 9, wherein the drive magnet is pneumatically driven.

11. The multi-component coating spray application system of claim 10, wherein the driver comprises a rotatable impeller with the drive magnet mounted thereon.

12. The multi-component coating spray application system of claim 7, wherein the driver comprises a drive chamber separate from the mixing chamber having an impeller rotatably mounted therein.

13. The multi-component coating spray application system of claim 12, further comprising a source of pressurized air in fluid flow communication with the drive chamber for rotating the impeller.

14. The multi-component coating spray application system of claim 13, further comprising a permanent magnet mounted on the impeller, wherein the stirring element comprises an elongated magnet which rotates upon rotation of the impeller and the permanent magnet mounted thereon.

15. The multi-component coating spray application system of claim 1, wherein:

the mixing chamber comprises a cylindrical sidewall, a base, and a top;

the inlet ports, the cylindrical baffle, and the outlet port are disposed toward the top of the mixing chamber; and the movable stirring member is disposed toward the base of the mixing chamber.

16. A dynamic mixer for multi-component coating comprising:

a substantially cylindrical mixing chamber comprising a cylindrical sidewall, a base, and a top;

a movable stirring element disposed toward the base of the mixing chamber;

a cylindrical baffle disposed toward the top of the mixing chamber;

a first inlet port connectable to a source of a first coating component, wherein the first inlet port is disposed toward the top of the mixing chamber and is directed toward the cylindrical baffle;

a second inlet port connectable to a source of a second coating component, wherein the second inlet port is disposed toward the to of the mixing chamber and is directed toward the cylindrical baffle; and an outlet port connectable to a spray gun, wherein the outlet port is defined by an inner circumference of the cylindrical baffle and is disposed toward the top of the mixing chamber.

17. A method of mixing multiple coating components prior to spray application, the method comprising:

providing first and second coating components to a mixing chamber;

mixing the first and second coating components in the mixing chamber with a movable stirring element to form a coating mixture; and feeding the coating mixture from the mixing chamber to a coating spray gun, wherein the mixing chamber comprises:

a substantially cylindrical mixing chamber;

a movable stifling member in the mixing chamber;

inlet ports which direct the first and second components radially inward into the mixing chamber;

a cylindrical baffle located in radial inward flow paths of the first and second components for diverting the inward flows of the first and second components to a flow toward the movable stirring member; and an outlet port defined by an inner circumference of the cylindrical baffle and disposed opposite to the movable stirring member.

* * * * *